United States Patent [19]

Shida

[11] Patent Number: 4,986,166

[45] Date of Patent: Jan. 22, 1991

[54] HYDRAULIC VALVE LASH ADJUSTER

[75] Inventor: Toshimitsu Shida, Fujisawa, Japan

[73] Assignee: Fuji Valve Co., Ltd., Tokyo, Japan

[21] Appl. No.: 412,500

[22] Filed: Sep. 26, 1989

[30] Foreign Application Priority Data

Mar. 28, 1989 [JP] Japan ..... 1-35338

[51] Int. Cl.[5] ..... F01B 7/20

[52] U.S. Cl. ..... 92/52; 123/90.55

[58] Field of Search ..... 92/51, 52; 123/90.55

[56] References Cited

U.S. PATENT DOCUMENTS

| | | | |
|---|---|---|---|
| 4,367,701 | 1/1983 | Buente | 123/90.55 |
| 4,392,462 | 7/1983 | Lesher | 123/90.55 |
| 4,397,271 | 8/1983 | Gardner | 123/90.55 |
| 4,477,714 | 10/1984 | Zorn et al. | 219/149 |
| 4,530,319 | 7/1985 | Honda | 123/90.46 |
| 4,584,976 | 4/1986 | Hillebrand | 123/90.55 |
| 4,610,225 | 9/1986 | Camosso et al. | 123/90.55 |
| 4,621,598 | 11/1986 | Miura | 123/90.46 |
| 4,644,914 | 2/1987 | Morita et al. | 123/90.55 |
| 4,708,103 | 11/1987 | Speil | 123/90.55 |
| 4,729,350 | 3/1988 | Speil | 123/90.55 |

*Primary Examiner*—Ronald C. Capossela

*Attorney, Agent, or Firm*—Cushman, Darby & Cushman

[57] ABSTRACT

The present invention relates to a hydraulic valve lash adjuster with which a cam engages directly and in which an oil-introducing chamber can be easily cleaned by a fluid or gas jet stream. In the valve lash adjuster in accordance with the present invention, the cylinder sleeve is formed through its lateral wall with a plurality of openings, and an annular oil-introducing chamber defined between the body and cylinder sleeve is communicated through the openings with the reservoir and consequently with the high pressure chamber. With the above construction of the invention, an extraneous substance such as chips and particles can be removed from the oil-introducing chamber along a fluid jet stream. Thus, since the oil-introducing chamber can be easily and perfectly cleaned by a jet stream during the manufacturing process and moreover during any overhaul work thereafter, reliability and maintainability of the product is markedly improved.

2 Claims, 2 Drawing Sheets

HYDRAULIC VALVE LASH ADJUSTER

BACKGROUND OF THE INVENTION

1. Field of the Invention

The present invention relates to a hydraulic valve lash adjuster of a direct-drive type, and more specifically, to a hydraulic valve lash adjuster with which a cam engages directly and in which an oil-introducing chamber can be easily cleaned by washing.

2. Description of Related Art

A conventional hydraulic valve lash adjuster of the direct-drive type includes a hollow cylindrical body with which a cam engages directly, and is slidably mounted within a bore formed in a cylinder head. The body is provided with a cylinder sleeve which is located coaxially with the body. There is formed an annular oil-introducing chamber between the inner surface of the body and the outer surface of the cylinder sleeve. The cylinder sleeve is provided therein with a hydraulic unit.

Engine-operating oil is introduced through the oil-introducing chamber into the hydraulic unit. The oil-introducing chamber is closed up except for one inlet and outlet so as to store sufficient oil therein. Thus, the valve lash adjuster is constructed so that no substantial quantity of air will come into the hydraulic unit even when the engine is started and no oil is being supplied to the valve lash adjuster.

Accordingly, in the conventional hydraulic valve lash adjuster of the direct-drive type in which the oil-introducing chamber is closed up except for one inlet and outlet it is difficult to remove from the oil-introducing chamber any extraneous substance such as chips or particles which accidentally enter it. In particular, during the manufacturing process of the body, cleaning of the interior of the body or the oil-introducing chamber by washing is very difficult. Therefore, if such chips and particles generated during the manufacturing process remain unremoved within the body, they will find their way into the hydraulic unit during the operation of the engine and prevent smooth sliding operation of the hydraulic unit. Consequently, the hydraulic valve lash adjuster as a whole will no longer be able to fulfill its function.

SUMMARY OF THE INVENTION

Accordingly, it is an object of the invention to eliminate the above-mentioned disadvantages and provide a hydraulic valve lash adjuster in which the extraneous substances such as chips and particles can be easily and completely removed from the oil-introducing chamber.

The above and other objects of the present invention can be achieved by a hydraulic valve lash adjuster which includes a cylindrical body with its upper end closed; a cylinder sleeve mounted on the upper end wall of the body and located coaxially with the body; an outer plunger having its lower end face in contact with the end face of the engine valve and slidably received within the cylinder sleeve; an inner plunger slidably received within the outer plunger, the inner plunger being formed therein with a reservoir; and check valve means for permitting oil to flow only from the reservoir into a high-pressure chamber defined between the the bottom wall of the inner plunger and the bottom wall of the outer plunger; characterized in that the cylinder sleeve is formed through its lateral wall with a plurality of openings.

In the hydraulic valve lash adjuster in accordance with the present invention, the cylinder sleeve is formed through its lateral wall with a plurality of openings, and an annular oil-introducing chamber defined between the body and cylinder sleeve is communicated through the openings with the reservoir and consequently with the high pressure chamber. With the above construction of the invention, any extraneous substance such as chips and particles can be removed from the oil-introducing chamber along a fluid jet stream as described later in detail. Thus, since the oil-introducing chamber can be easily and completely cleaned by the jet stream during the manufacturing process and moreover later during any overhaul work, the reliability and maintainablity of the product is markedly improved.

In a preferred embodiment of the invention, the cylinder sleeve is formed with two openings located in a radially opposed relation with each other.

The above and other objects, features and advantages of the present invention will become apparent from the following detailed description of preferred embodiments of the present invention with reference to the accompanying drawings.

DESCRIPTION OF THE PREFERRED EMBODIMENT

Figure 1:
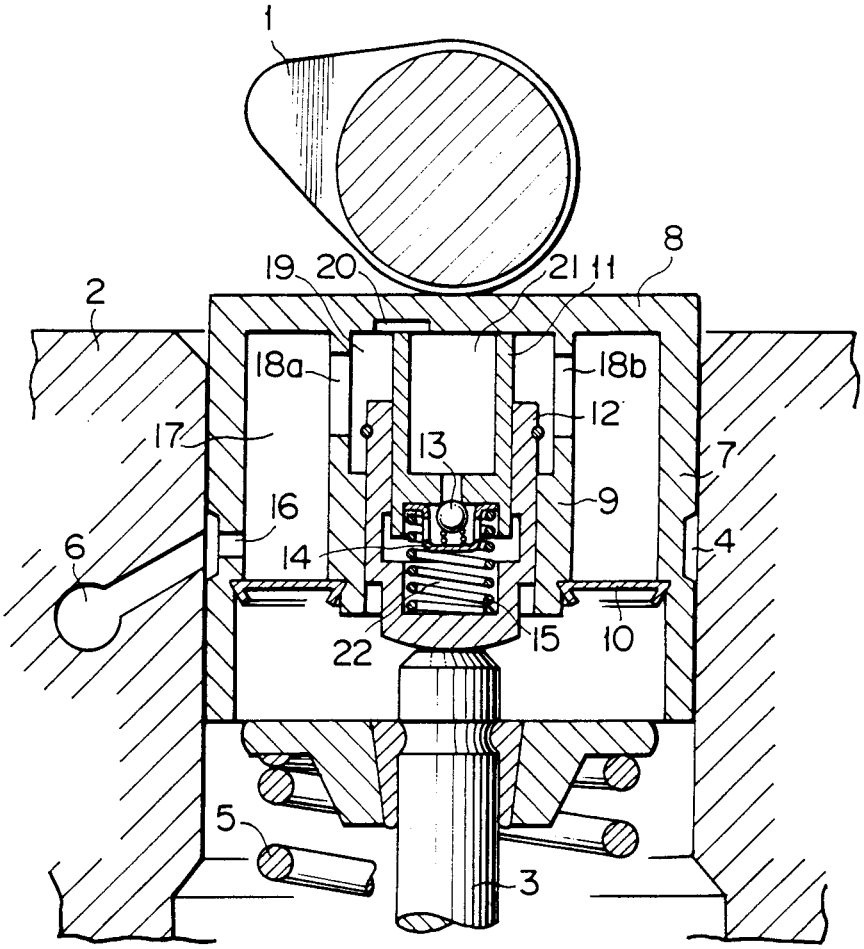
FIG. 1 is a cross sectional view schematically showing the construction of a hydraulic valve lash adjuster in accordance with the present invention.

Referring to FIG. 1, there is shown a hydraulic valve lash adjuster constructed in accordance with the present invention.

The shown hydraulic valve lash adjusters comprises a cylindrical body 7 with its upper end closed. The body 7 is slidably received within a bore formed in a cylinder head 2. The body 7 is provided therein with a cylinder sleeve 9. The cylinder sleeve 9 is located coaxially with the body 7 and secured to the upper end wall 8 of the body 7. There is defined an annular oil-introducing chamber 17 by the inner surface of the body 7, the outer surface of the cylinder sleeve 9, and the under surface of the end wall 8. The oil-introducing chamber 17 is provided at its lower end with an annular cover 10.

The body 7 is formed at its outer surface with a annular oil-supplying groove 4 communicating with an oil gallery 6 formed in the cylinder head 2. The body 7 is further formed through its lateral wall with a first oil orifice 16 communicating with the groove 4. The oil gallery 6 is thus communicated through the groove 4 and the first oil orifice 16 with the oil-introducing chamber 17.

Within the cylinder sleeve 9, an outer plunger 12 with its lower end closed is slidably received, and an inner plunger 11 is slidably mounted within the outer plunger 12. The inner plunger 11 is located in a position such that its upper end face or open end face is in contact with the under surface of the end wall 8 of the body 7. The end wall 8 is formed at its under surface with a concave portion 20 which allows a reservoir 21 formed within the inner plunger 11 and a passage 19 within the cylinder sleeve 9 to communicate with each other. The passage 19 is communicated with the oil-introducing chamber 17 through two second oil orifices 18*a*, 18*b* formed through the lateral wall of the cylinder sleeve 9.

Between the bottom end wall of the inner plunger 11 and that of the outer plunger 12, there is formed a high pressure chamber 22 which communicates through a check valve 13 with the reservoir 21. The high pressure chamber is provided therein with a return spring 15 which urges the inner plunger 11 out of the outer plunger 12. The check valve 13 is held in position under the action of a spring located between the check valve 13 and a retainer 14.

In operation, a downward force is applied to the end wall 8 of the body 7 under the action of a cam 1. Such downward force is transmitted through the body 7, inner plunger 11 and high pressure chamber 22 to the outer plunger 12 to push an engine valve 3 open. At this moment, the outer plunger 12 is subjected to the action of a valve spring 5 so that a high pressure is generated within the high pressure chamber 22. As a result, the oil stored in the high pressure chamber 22 leaks through an annular gap between the inner and outer plungers 11, 12. The outer plunger 12 is pushed upward by a distance corresponding to the amount of the leaked oil.

When the engine valve 3 returns to a closed position, the outer plunger 12 is released from the action of the valve spring 5 and accordingly a slight gap or clearance is about to be formed in the valve motion mechanism. However, since the outer plunger 12 is pushed downward under the action of the return spring 15, the gap or clearance is instantly reduced to zero. At this moment, the pressure within the high pressure chamber 22 becomes lower than that within the reservoir 21 to permit the oil stored in the reservoir 21 to flow through the check valve 13 into the high pressure chamber 22. Simultaneously, the oil in the oil gallery 6 is supplied to the reservoir 21 through the groove 4, first oil orifice 16, oil-introducing chamber 17, second oil orifices 18*a*, 18*b*, passage 19 and concave portion 20. The above operation cycle is repeated so that the clearance of the valve motion mechanism can be always kept to zero, or in other words, so that no substantial gap will be formed between the engine valve 3 and the bottom end wall of the outer plunger 12.

In the manufacturing of the hydraulic valve lash adjuster, the end wall 8 and lateral wall of the body 7 and the cylinder sleeve 9 are formed by forging or machining. In addition, the cover 10 is formed by pressing in the usual manner, and secured to the lower ends of the cylinder sleeve 9 and body 7 by caulking, brazing, welding or other appropriate methods. Chips and particles are generated during the subsequent cutting and polishing processes, and enter the oil-introducing chamber 17. Such chips and particles have to be removed.

In conventional hydraulic valve lash adjusters, there are some portions where the fluid jet stream cannot reach and, therefore, it is very difficult to remove extraneous substances from those portions. However, with the structure provided in accordance with the present invention, the fluid jet stream can be thoroughly or evenly introduced into the oil-introducing chamber.

Figure 2:
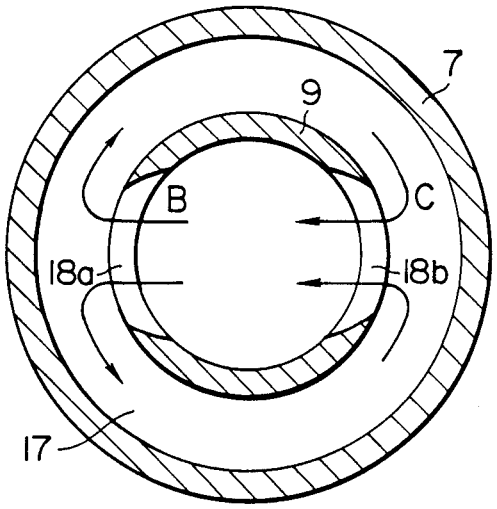
FIG. 2 is a cross sectional view showing the location of the second oil inlet of the hydraulic valve lash adjuster shown in FIG. 1 together with the flow direction of a washing jet stream.
Figure 3:
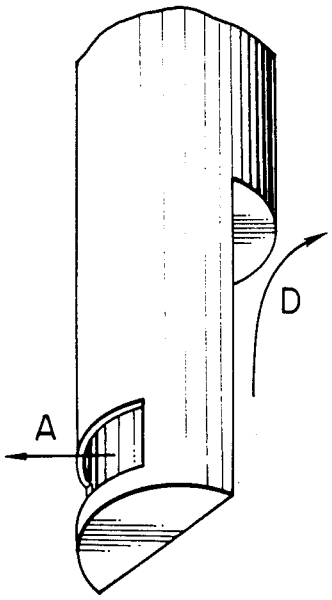
FIG. 3 is a view showing the construction of the nozzle used for washing the oil-introducing chamber.

In the above embodiment, the cylinder sleeve is formed through its lateral wall with the two openings. The chips and particles within the oil-introducing chamber can be, therefore, removed by the steps of inserting the nozzle shown in FIG. 3 into the cylinder sleeve, and generating the fluid jet stream indicated by arrows A to D as shown in FIGS. 2 and 3. Thus, the chips and particles can be entrained by the stream and removed from the oil-introducing chamber.

In the embodiment described, the second oil orifices are formed in a radially opposed relation with each other. However, in order to attain the advantageous effect of the present invention, it is required only that two or more oil orifices be formed through the lateral wall of the cylinder sleeve. Accordingly, in the hydraulic valve lash adjuster in accordance with the present invention, the number and position of the orifices are not limited to those in the embodiment.

Furthermore, though the cover is formed separately and secured to the cylinder sleeve in the embodiment, the cover may be formed integrally with the cylinder sleeve.

Although the invention has thus been shown and described with reference to specific embodiments, it should be noted that the present invention is in no way limited to the details of the illustrated structures but changes and modifications may be made within the scope of the appended claims.

What is claimed:

1. A hydraulic valve lash adjuster comprising:

a cylindrical body having a closed upper end, defined by an upper end wall, a lower end and a longitudinal axis;

a cylindrical sleeve mounted to said upper end wall of said body and extending coaxially with said longitudinal axis of said body, said cylindrical sleeve having a plurality of openings defined therethrough;

an outer plunger having a bottom wall defining a lower end face, said lower end face of said outer plunger being in contact with an end face of the engine valve stem, said outer plunger being slidably disposed within said cylindrical sleeve;

an inner plunger having a bottom wall, said inner plunger being slidably received with said outer plunger and having a reservoir defined therewithin; and check valve means for permitting oil to flow only from said reservoir in said inner plunger into a high-pressure chamber defined between said bottom wall of said inner plunger and said bottom wall of said outer plunger.

2. A hydraulic valve lash adjuster as in claim 1, wherein two of said openings defined through said cylindrical sleeve are disposed in radially opposed relation to one another.

* * * * *